United States Patent [19]

Cushing

[11] 4,028,012

[45] June 7, 1977

[54] SEALING MEANS FOR A DISHWASHER TUB AND MOTOR ASSEMBLY

[75] Inventor: Donald S. Cushing, Louisville, Ky.

[73] Assignee: General Electric Company, Louisville, Ky.

[22] Filed: June 2, 1975

[21] Appl. No.: 582,662

[52] U.S. Cl. ..... 417/360; 277/208; 277/212 FB; 134/59

[51] Int. Cl.[2] ..... F04B 17/00; F16J 15/06

[58] Field of Search ..... 417/360, 363; 134/56 D, 134/57 D, 58 D, 59; 277/212 FB, 207 A, 208

[56] References Cited

UNITED STATES PATENTS

| | | | |
|---|---|---|---|
| 2,615,741 | 10/1952 | Nathan | 277/207 A |
| 2,896,974 | 7/1959 | Bush | 277/208 |
| 3,367,368 | 2/1968 | Jenkins | 417/502 X |
| 3,825,373 | 7/1974 | Jenkins | 417/360 |
| 3,841,342 | 10/1934 | Cushing et al. | 134/176 X |

FOREIGN PATENTS OR APPLICATIONS

| | | | |
|---|---|---|---|
| 270,403 | 4/1967 | Austria | 277/212 FB |

*Primary Examiner*—Carlton R. Croyle
*Assistant Examiner*—Thomas I. Ross
*Attorney, Agent, or Firm*—Francis H. Boos

[57] ABSTRACT

A novel sealing arrangement for mounting a combination pump-motor assembly in sealed relationship to the bottom opening of a dishwasher tub, whereby a fluid-tight seal is insured, notwithstanding thermal expansion and contraction of the tub bottom. The seal is effected between a circumferential downwardly directed bead, of a flexible shroud that covers the assembly, and an upwardly facing grooved lip which defines the opening in the tub bottom whereby the weight of the wash fluid in the tub tends to enhance the sealing action.

4 Claims, 5 Drawing Figures

SEALING MEANS FOR A DISHWASHER TUB AND MOTOR ASSEMBLY

BACKGROUND OF THE INVENTION

This invention relates to a dishwasher having a single unit motor-pump assembly which is adapted to be installed downwardly through the bottom of the wash chamber. More specifically, it relates to the means for providing a fluid-tight seal between the pump and motor assemble and the wash chamber bottom, after the pump-motor assembly is installed.

Conventional automatic domestic dishwashers are generally provided with a pump-motor arrangement disposed entirely below the level of the bottom of the wash chamber of the dishwasher. This requires a substantially large service area below the wash chamber to permit access to the pump and motor and other related components. It has been found desirable to enlarge the capacity of the wash chamber of a dishwasher while maintaining the overall vertical dimensions of the machine in keeping with normal countertop heights and without expanding the width or depth of the cabinet beyond conventional dimensions. One way to increase the size of the wash chamber in the dishwashing machine is to expand it vertically by lowering the bottom. This, however, results in there being less space for the motor and pump arrangement to be located therebelow.

It has been found to be feasible, however, to provide that the pump and motor unit protrude upwardly through the bottom of the dishwasher tub into the wash chamber, thus allowing maximum tub size. This end can be accomplished by providing a flexible boot or shroud such as that shown in U.S. Pat. No. 3,825,373. There are, however, problems with providing an effective, inexpensive, reliable seal between the shroud and the tub bottom.

SUMMARY OF THE INVENTION

The present invention is directed to a seal means for effecting a fluid-tight seal between a shroud or boot and the tub bottom of a dishwasher. The shroud is sealed to the bottom wall of the tub in a manner which insures that the seal can be maintained in spite of variations in the thermal coeffieient of the material of the tub bottom and the material of the shroud itself.

More specifically, the invention includes a dishwasher having an internal wash chamber with a bottom wall and an opening therethrough, the improvement comprising a motor-pump assemble disposed within the opening and partially projecting above the level of the bottom wall; rigid support means associated with the bottom wall for supporting a pump- motor assembly in a removably attached relationship with the wash chamber bottom wall; sealing means associated with the bottom wall including an upwardly facing groove parametrically positioned at the outer edge of said opening for exerting a clamping force radially against a downwardly directed bead member of the resilient shroud therein for compressibly sealing said resilient shroud in fluid-tight relationship with the bottom wall of the tub, the size of the groove being in a ratio of 4 to 5 with respect to the size of the bead, thereby accommodating thermal expansion of said groove without disturbing the integrity of said seal.

The shroud also preferably includes a sump formed therein which extends below the wash chamber bottom wall and cooperates with the pump intake projecting through the shroud to provide for a minimum of water remaining in the wash chamber after the final pump-out of the last rinse.

Further, advantageously, the portion of the wash chamber bottom wall defining the opening is formed in a low level annular depression to receivably direct the pump-motor assemble in position within the opening during downward installation thereof.

DESCRIPTION OF THE PREFERRED EMBODIMENT

Figure 1:
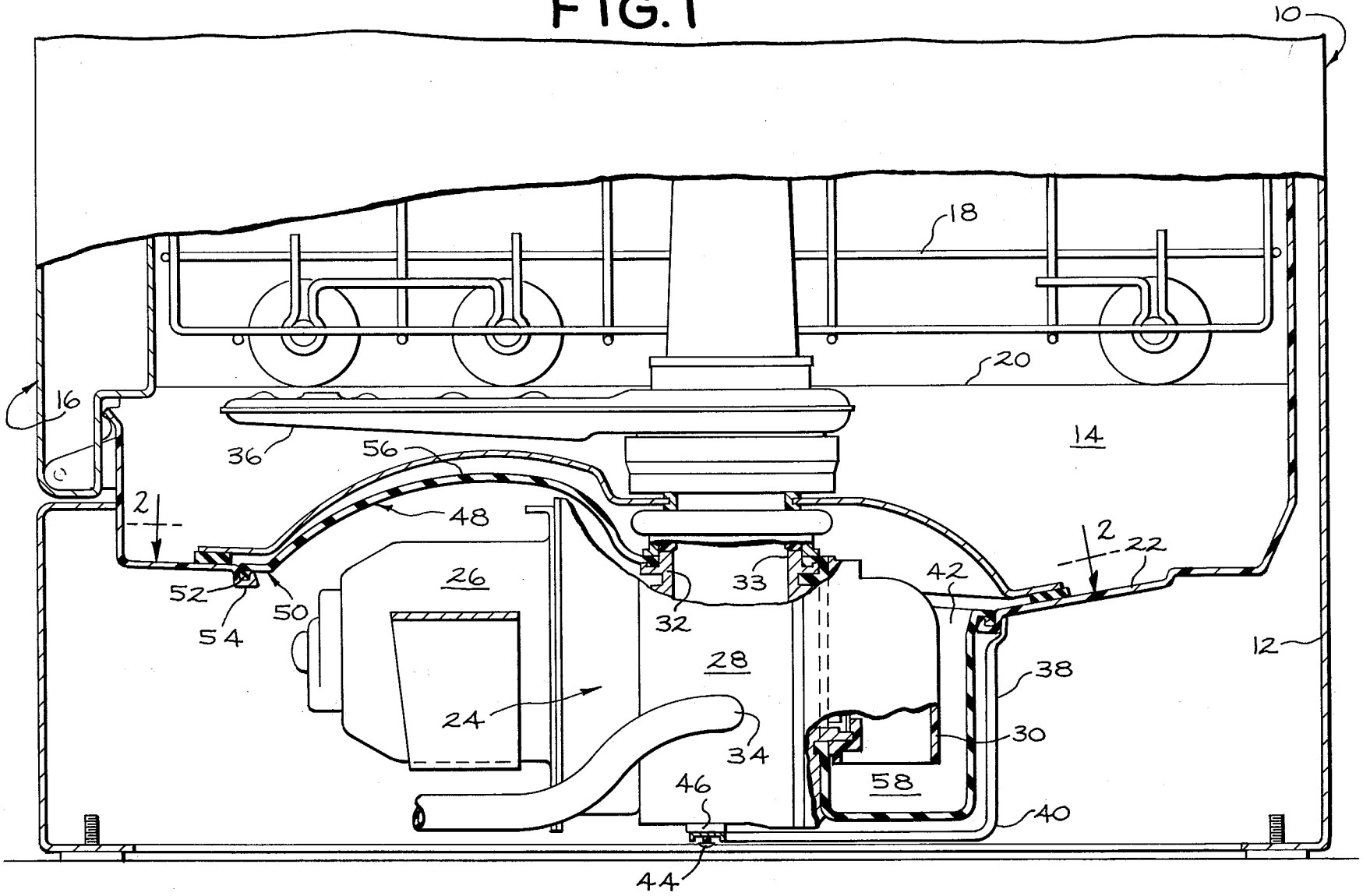
FIG. 1 is a partial elevational view of a dishwasher showing the tub bottom and the sroud with the single-unit pump and motor located therebelow.
Figure 2:
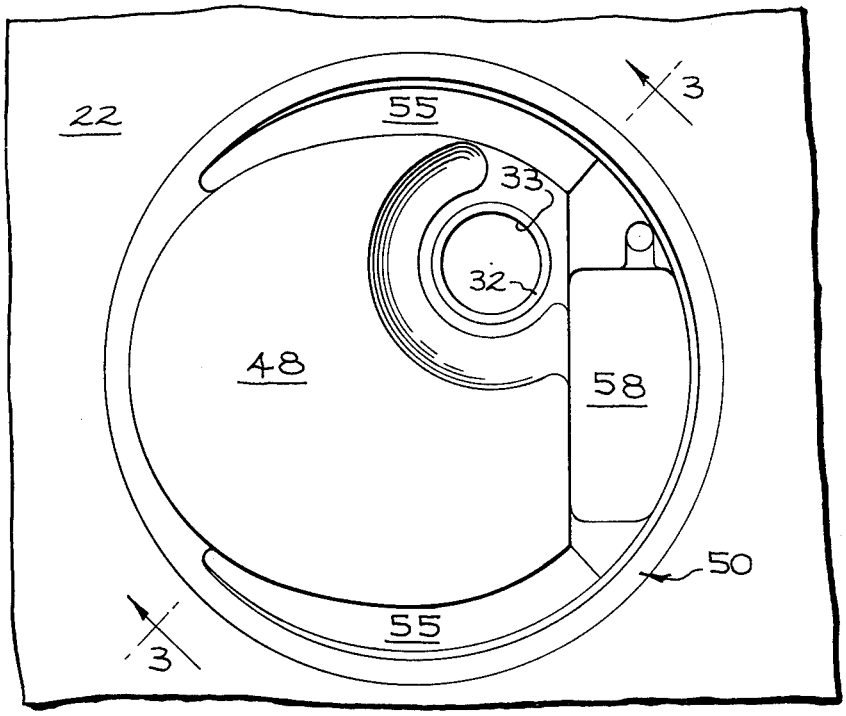
FIG. 2 is a plan view taken along line 2-2 of FIG. 1 with parts removed.
Figure 3:
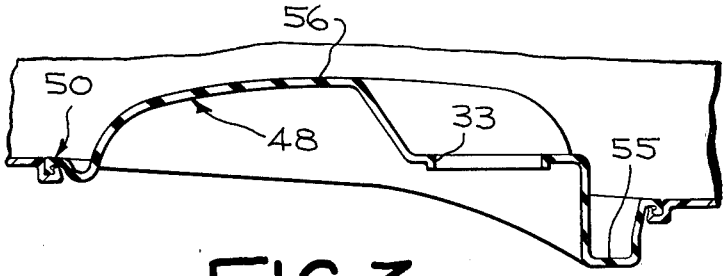
FIG. 3 is a partial view taken along the lines 3—3 of FIG. 2.

In FIG. 1 there is shown the lower front portion of an automatic dishwasher 10 housing an internal wash chamber 14. The wash chamber 14 has a front access opening which is closed by a door 16. Shown within the wash chamber 14 is a rack 18 for supporting dishes to be washed. The rack 18 is roller supported on side ledges 20 formed in the wash chamber sidewall whereby it can be manually moved outwardly over the open door 16 for loading and unloading of dishes therefrom.

The wash chamber 14 has a bottom wall 22 that slopes gradually downwardly toward its center. The bottom wall 22 has a substantially central opening therethrough that is occupied by a single-unit motor-pump assemble 25 suspended therein with a motor 26 and pump 28 situated one adjacent the other (see FIG. 1).

The electric motor 26 may be a shaded-pole type having a horozontally-extending shaft connected to the pump impeller within the pump housing. The pump 28 is of the type disclosed in U.S. Pat. No. 3,367,368. In accordance with that disclosure, the pump 28 has a liquid intake conduit 30 and an upper side outlet in the form of a tubular pedestal 32 and a drain outlet or hose 34. A solenoidactuated valve (not shown) in the pump 28 serves to direct liquid taken in through the intake conduit 30 either upwardly through the conduit 32 and thence outwardly through the orifices of a spray arm 36 or outwardly through the drain hose 34, depending upon the valve position.

The motor 26 is of the non-reversible type and is energized to rotate the pump impeller in one direction when the valve arrangement is disposed to conduct pumped liquid through the spray arm 36 and in the same direction when the valve arrangement is disposed to direct liquid out through the drain hose 34.

The motor 26 and pump 28 are cradled by a rigid support member or leg 38 that projects downwardly inwardly and joins to a sling-like element 40 that serves to suspend the motor and pump centrally within the opening 42. Provision is made for fastening means such as a bolt 44 for fastening the motor-pump assemble through an opening provided therefor in the member 40 and thence through a resilient shock absorber pad 46. The upper end of the bolt 44 screws into a tapped socket provided therefor in the housing of the pump 28. The pump-motor assembly includes a resilient shroud or cover 48 that serves to sealably blanket and protect the motor and pump from washing liquid contained within the wash chamber 14. The conduit 32 projects upwardly through a center opening 33 in the shroud 48 and is sealed therewith to prevent liquid moving downwardly along the outside of the pedestal.

A peripheral edge 50 includes a downwardly directed bead portion 52 which is sized to be received in an upwardly facing groove 54 of the bottom wall 22.

The sizing of bead 52 is critical to the workability of the invention. Specifically, it has been found that the bead width at its widest portion must be wider than the widest portion of the groove 54. The proportion of widths must be in the ratio of 4 to 5 in order that thermal expansion of the groove causing a widening thereof does not have the effect of destroying the integrity of the compression seal between the bead and the groove. Further, this ratio insures that after a prolonged use period there will be maintained an integral seal even though the resilience of the shroud may be reduced by some 40% due to aging. It will be noted that the bead and groove arrangement described herein eliminates many of the traditional problems of sealing a combination of parts such as described here. These problems include differential expansion of clamps and the tub bottom, especially if the tub is made of plastic. Similarly, the problems of plastic creep and misalignment of clamps are obviated.

The shroud 48 is formed with a center hump portion 56 sealably surrounding the conduit 32 and has a low-level pocket serving as a well or sump area 58, into which washing liquid from the wash chamber may qravitate to be picked up by the intake conduit 30 of the pump 28. The portion 55 of the shroud 48 circumjacent the humped portion 56 may be downwardly channeled to direct accumulated liquid into the sump area 58. The intake 30 of the pump 28 has a downwardly facing opening adjacent the bottom of the sump 28 whereby very little liquid carry-over will remain in the sump between consecutive uses of the dishwasher. The intake 30 of the pump, like the conduit 32, projects through an opening in the shroud in sealed relation therewith.

Figure 4:
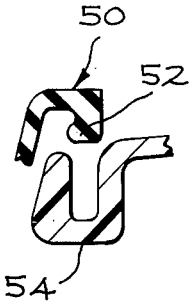
FIG. 4 is an enlarged view of the bead and groove of FIG. 3.
Figure 5:
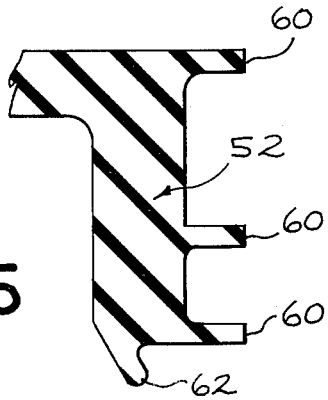
FIG. 5 is a magnified view of an alternative embodiment of the bead shown in FIG. 4.

FIG. 5 is an alternative embodiment of bead 52 shown in FIG. 4. This alternative bead includes three parallel flanges 60 and a tip 62, all of which are flexible. thus, upon insertion of the bead 52 into a groove 54, the flanges 60 are flexed in an upwardly direction to provide a seal as well as to provide resistance to being removed therefrom. Tip 62 is bent upon insertion into groove 54 to further enhance the fluid tightness of the seal between bead 52 and groove 54. This is accomplished by tip 62 flexing to thereby bias in a resilient fashion against the bottom of the groove. However, it is still imperative that the width of the groove as compared to the effective width of the bead, i.e., thickness of the bead after insertion into the groove with flanges flexed, must be in the ratio of 4 to 5.

It will be noted that groove 54 of the bottom wall 22 that defines the opening in which the pump- motor unit is disposed is formed in a low-level depression or downwardly recessed configuration whereby, when the motor-pump unit is installed through the wash chamber 14 and placed into position, it will tend to self-center on the support mechanism with the bead 52 centering adjacent the groove 54.

Contrary to more conventional dishwashing machines, the structure of the present invention provides a comparatively small area beneath the bottom wall 22 of the wash chamber 14 whereby the vertical dimension of the wash chamber 14 can be substantially elongated without changing the predetermined outside cabinet vertical dimension, thus providing a substantially greater dishwashing area. Factory assembly of such a dishwasher is greatly simplified, inasmuch as the motor-pump assembly can be independently assembled and then relatively easily installed through the wash chamber 14 rather than from beneath the wash chamber as generally heretofore required. Servicing or replacement of the motor- pump assembly is also relatively easy, requiring only the disconnection of the drain conduit 34 from the pump 28 and the electrical connections to the motor 26; then removal of the pump and motor arrangement can be effected from the top side of the machine. It should also be noted that the downwardly directed bead 52 of the shroud 48 is installed into the upwardly facing groove 54 by working from within the wash chamber 14. Thus, it is unnecessary to work on the motor-pump assembly from beneath the dishwasher.

Having thus described the invention, what is claimed is:

1. In a dishwasher having an internal wash chamber including a bottom wall with an opening therethrough, the improvement comprising:

a motor-pump assembly disposed within the opening and partially projecting above the level of the bottom wall;

rigid support means associated with the bottom wall for supporting the pump-motor assembly in a removably attached relationship with the wash chamber bottom wall;

a resilient shroud overlying said pump-motor assembly and preselectively sized to cover said opening;

sealing means associated with said bottom wall including an upwardly facing groove peripherally positioned at the outer edge of said opening for exerting a clamping force radially against a downwardly directed bead member of said resilient shroud that is inserted therein for compressibly sealing the periphery of said resilient shroud in fluidtight relationship with the bottom wall of said tub, said bead being installed into the groove from within the wash chamber, said groove being preselectively sized, as compared to the size of the bead, when uncompressed, to be in a ratio of four to five, thereby accommodating thermal expansion of said groove without disturbing the integrity of said seal.

2. The dishwasher of claim 1 wherein the shroud covers the pump-motor assembly and includes a sump formed therein and extending below the wash chamber bottom wall and the pump has an intake projecting through the shroud and into the sump.

3. The dishwasher of claim 1 wherein the portion of the wash chamber bottom wall defining the opening is located in a low-level annular depression to receivably seat the pump-motor assembly in position within the opening during downward installation thereof.

4. The dishwasher of claim 1 wherein the bead includes three parallel flanges and a flexible tip such that, upon insertion of the bead into said groove, the flanges are flexed in an upwardly direction to provide a seal and provide resistance to being removed therefrom and said tip is bent upon insertion into said groove to further enhance the fluid tightness of the seal between said bead and said groove.

* * * * *